United States Patent [19]

Bridges

[11] 4,250,351

[45] Feb. 10, 1981

[54] CABLE CONSTRUCTION

[75] Inventor: Robert M. Bridges, Northridge, Calif.

[73] Assignee: The Bendix Corporation, North Hollywood, Calif.

[21] Appl. No.: 64,926

[22] Filed: Aug. 8, 1979

[51] Int. Cl.[3] ..... H01B 7/14

[52] U.S. Cl. ..... 174/106 R; 174/36; 174/70 S; 174/108; 174/115

[58] Field of Search ..... 174/36, 70 S, 106 R, 174/108, 115, 116

[56] References Cited

U.S. PATENT DOCUMENTS

| | | | |
|---|---|---|---|
| 2,604,509 | 7/1952 | Balnchard | 174/108 |
| 2,754,352 | 7/1956 | Connell | 174/108 X |
| 3,602,632 | 8/1971 | Ollis | 174/36 |
| 3,634,607 | 1/1972 | Coleman | 174/108 X |
| 3,773,109 | 11/1973 | Eberline | 174/108 X |
| 3,784,732 | 1/1974 | Whitfill | 174/108 |
| 3,800,066 | 3/1974 | Whitfill | 174/108 X |
| 3,843,829 | 10/1974 | Bridges | 174/107 X |
| 4,010,619 | 3/1977 | Hightower | 174/115 X |
| 4,028,660 | 6/1977 | Pitts | 174/108 X |
| 4,045,611 | 8/1977 | Torgerson | 174/110 D |

OTHER PUBLICATIONS

Leber, A. W. et al., Ocean Cable and Couplings, Bell Syst. Tech. J., vol. 49, No. 5 (May–Jun. 1970) pp. 699 to 719.

*Primary Examiner*—Richard R. Kucia

*Attorney, Agent, or Firm*—Robert C. Smith; W. F. Thornton

[57] ABSTRACT

A construction for an electrical cable which carries an underwater transducer and is repeatedly reeled onto and from a hoist in a helicopter into the ocean to substantial depths. The cable includes a coaxial construction of copper conducting wires including a center conductor wound in a helix angle around a nylon center rod with the wires covered with a significant layer of polypropylene insulation and a tubular construction of fine copper wires wrapped around the polypropylene insulation in a helix angle and, in turn, wrapped with a copper-mylar tape with the copper layer adjacent the conducting wires. The tape is covered with a layer of polyvinylchloride insulation covered with an open-weave light Dacron braid bedding layer. The bedding layer serves to distribute forces from the armor layers which consist of a first layer of steel wires wound in a helix angle smaller than that of the conducting wires and in the opposite direction. A second armor layer consists of a layer of steel wires smaller than the wires of the first layer applied over the first layer and wound in the opposite direction for torque balancing. The wires of the armor layers are spaced slightly so that a final layer of polyurethane insulation is pressure-extruded into the layers between the wires and for a significant thickness over the armor wire layers to prevent puckering and separation of the outer jacket from reeling forces, etc.

10 Claims, 1 Drawing Figure

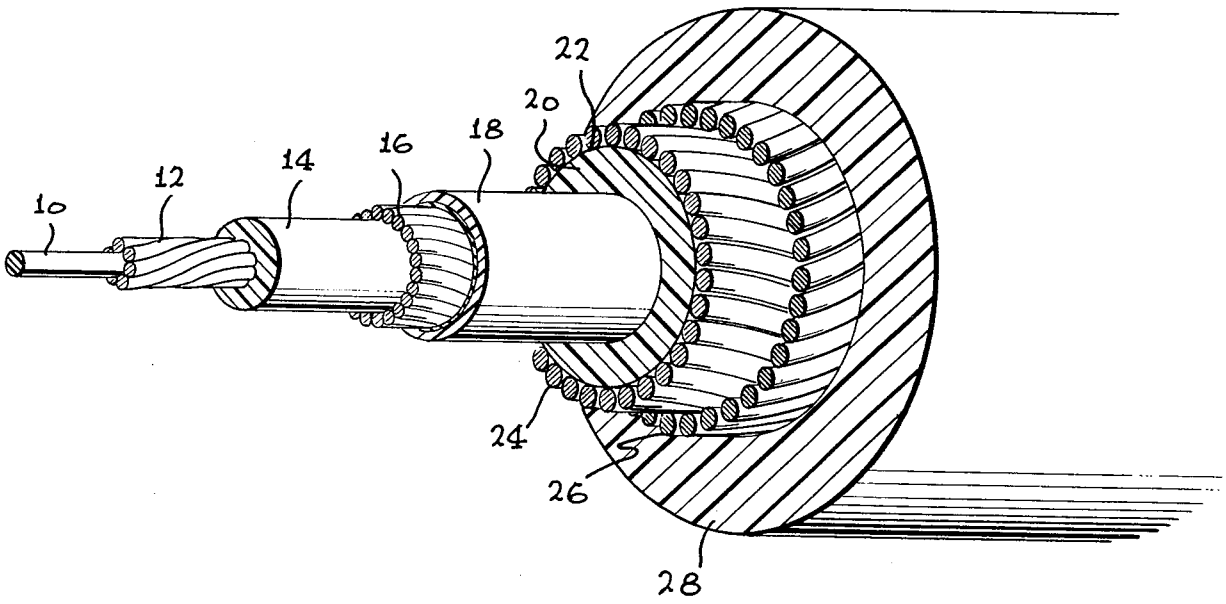
10
12
14
16
18
20
22
24
26
28

CABLE CONSTRUCTION

BACKGROUND OF THE INVENTION

There are several requirements for the performance of electrical cables used for airborne sonar. Such cables, in addition to carrying electrical signals, must support a fairly heavy transducer which is reeled into and pulled out of the water many times. Since physical orientation of the transducer is important, it is necessary that the cable be torque-balanced to avoid wind-up or spinning of the transducer while suspended. Because of the large number of reeling cycles, the cable must be strong enough to withstand fatigue stresses and should be designed to minimize damaging concentrated loads which frequently occur when the cable passes over a sheave. Additionally, it is known that such cables must dissipate very large static electricity charges and must shield the signal conductors from such charges as well as other electromagnetic interference from the helicopter. A cable which meets the above requirements is described in U.S. Pat. No. 3,843,829 (common assignee).

Recent requirements have made it necessary to design a new cable which meets the above qualifications but which operates at substantially greater depths. The cable must therefore be much longer. Since hovering time should not be substantially extended, the cable should withstand greater reeling speeds than eariler units. Also, the size and weight of the cable become more critical because of the required size of the storage reel and weight of cable to be carried on the helicopter. The size also effect hydrodynamic drag on the portion of the cable being immersed; obviously this should be minimized.

SUMMARY OF THE INVENTION

Because the previous cable design carried power lines and separate signal conductors for a large number of individual transducer elements, it was necessarily of a significant diameter (over 0.5 inch). The above described requirement for a much longer cable imposed an essentially mandatory requirement that the cross-section of area of the cable be substantially reduced. This was accomplished by modifying the associated equipment to provide multiplex transmission so that all the information and power could be carried on a single coaxial conductor.

The single coaxial cable has a center strand of thin nylon rod (like fish line) around which is wrapped, at a fairly high helix angle, seven strands of copper wire. This is covered by a layer of polypropylene insulation of significant thickness, and this, in turn, is then covered with the outside conductor consisting of many strands of fine copper wire spiraled at a fairly large helix angle and covered with a spiral layer of copper-Mylar tape with the copper side adjacent the copper wire strands. "Mylar" is a trademark for duPont's polyester film with "Dacron" the trademmark for duPont's polyester fiber both chemically labelled as polyethylene terephthalates. A thin layer of polyvinylchloride insulation materials covers the tape, and it is, in turn, covered with a bedding layer of light braid Dacron. The above structure is then armored by a first layer of hard drawn steel wires spirally wound in a first direction at a shallower angle than the copper wires, but not laid so tightly that the layers are substantially adjacent each other, and a second layer of slightly smaller wires spirally wound in the opposite direction from said first layer to provide torque balancing but also not wound so that the strands are closely adjacent. These armor layers are then covered with a substantial thickness of polyurethane insulation pressure extruded such that it penetrates the spaces between the armor wires. This avoids puckering and separation of the external jacket from reeling forces, etc. All the above is incorporated in an outside diameter of approximately 0.225 inch, which is substantially less than half of the diameter of the earlier cable discussed above. This, of course, makes for much less weight and hydrodynamic drag than would be the case if the larger, older design were used.

Some of the advantages of the new cable design are:

(1) With the oppositely wound armor wire, torque balancing is easily accomplished in manufacture and is effective;

(2) The armor wire layers with the insulation used are effective to protect the coaxial line from reeling stresses, etc., but since they are served in opposite directions they do not tend to wear excessively during reeling as would a braided layer;

(3) With the serving angle of the copper conductors greater than that of the steel armor wires, elongating loads are carried almost entirely by the steel armor wires as described in a technical paper by the inventor herein entitled "Structural Stresses in Undersea Cables—Their Effect on Reliability" in *Marine Technology Society Journal,* October-November 1978, Vol. 12, No. 5;

(4) The zinc-coated steel armor wires effectively ground the large static charges which commonly build up between the helicopter and the surface of the water so that they do not damage the circuits of the associated sonar system;

(5) The copper-Mylar tape provides excellent shielding for the coaxial line, yet requires a minimum of thickness;

(6) The bedding layer effectively distributes side compression stresses such as those occurring when the cable passes over a sheave; and (7) Both the polyvinylchloride jacket and the polyether polyurethane insulation are easily bonded to so that water-tight seals with termination hardware are readily attained.

DESCRIPTION OF THE DRAWING

The single FIGURE is a perspective view of a section of a cable according to my invention with various layers cut away to reveal the internal construction.

DESCRIPTION OF THE PREFERRED EMBODIMENT

Referring now to the drawing, a center rod 10 of 0.015-inch diameter nylon (like fishing line) is placed in the center of the cable around which is wrapped seven strands 12 of copper wire (0.010 inch) in a 20-degree right hand helix. These strands 12 of copper wire are covered with a sleeve 14 of polypropylene 0.175 inch thick to a total diameter of about 0.070 inch. An outer coaxial conductor 16 consists of 42 0.005-inch diameter bare copper wire spiraled at 20-degree right hand helix. These wires are then wrappped with a spiral of copper-Mylar tape 18 with the copper layer adjacent the wires 16. Covering the tape 18 is an outer insulation sleeve 20 0.010 inch thick around which is wrapped a "bedding layer" of open light braided Dacron 22 which distributes side compression stresses. This layer is immediately below a first armored layer 24 consisting of an inner layer 26 of 22 steel wires of 0.015 inch diamter wound in a left hand helix at 15 degrees. Immediately over the inner layer 24 is wound in a right hand helix at 20 degrees a second, outer layer 26 of 24 steel wires of 0.012-inch diameter. The individual armor layers are not wound quite tightly together, and an outer jacket 28 of 0.018-inch polyurethane is pressure-extruded over the armor layers so that the polyurethane flows between the wires, holding the jacket tightly to the armored layer to avoid rucking or separation from the stresses of reeling the cable over a sheave. The entire cable has a diamter of approximately 0.225 inch, has a maximum breaking strength of 1500 pounds, and weighs in air only 44.5 pounds per 1000 feet.

I claim:

1. An electrical cable comprising a center rod of nonconducting material and a plurality of conducting wires wrapped around said rod in a helix angle;

a layer of polypropylene insulation surrounding and enclosing said conducting wires, a layer of fine conducting wires spiraled over the surface of said polypropylene insulation in a helix angle and a wrap over said fine conducting wires of copper-polyester film tape with the copper layer thereof adjacent said wires;

a layer of polyvinylchloride insulation covering said wrap, a bedding layer of light braided polyester fiber covering said polyvinylchloride insulation layer, a first layer of steel armor wires wrapped in a helical angle over said bedding layer, a second layer of steel armor wires wrapped in a helical angle over said first layer but wrapped in the opposite direction to effect torque balancing, said armor wires being spaced slightly from each other, and an external jacket of polyurethane insulation material pressure-extruded over said armor wires.

2. An electrical cable as claimed in claim 1 wherein said insulation jacket is extruded into the spaces between said steel armor wires.

3. An electrical cable as claimed in claim 1 wherein the helix angle of at least one of said steel armor wires is significantly less than the helix angle of said conducting wires.

4. An electrical cable as claimed in claim 1 wherein the diameter of said cable is approximately 0.225 inch.

5. An electrical cable as claimed in claim 1 wherein said first armor layer includes wires of a larger diameter than the wires of said second armor layer and said second armor layer includes a greater number of wires than said first armor layer.

6. An electrical cable as claimed in claim 5 wherein said first armor layer includes twenty-two steel wires of 0.015 inch and said second armor layer includes twenty-four steel wires of 0.012 inch diameter.

7. An electrical cable comprising a center rod of nonconducting material and a plurality of conducting wires wrapped around said rod in a helical angle;

insulating material surrounding and enclosing said conducting wires, a layer of fine conducting wires spiraled over the surface of said insulating material in a helical angle and a wrap of insulating tape having a conducting surface adjacent said wires, a layer of fine conducting wires spiraled over the surface of said insulating material in a helical angle and a wrap of insulating tape having a conducting surface adjacent said wires, a layer of insulating material covering said wrap, a bedding layer of light braided dacron material covering said insulation layer, a first layer of steel armor wires wrapped in helical angle over said bedding layer, a second layer of steel armor wires wrapped in a helical angle over said first layer but wrapped in the opposite direction for torque balancing, and an external jacket of insulation material extruded over said armor wires.

8. An electrical cable as claimed in claim 7 wherein said first armor layer includes wires of a larger diameter than the wires of said second armor layer and said second armor layer includes a greater number of wires than said first armor layer.

9. An electrical cable as claimed in claim 7 wherein said steel armor wires are spaced slightly from each other and said insulation jacket is pressure-extruded into spaces between said wires.

10. An electrical cable as claimed in claim 7 wherein the helix angle of at least one of said steel armor wires is significantly less than the helix angle of said conducting wires.

* * * * *